US007475573B2

(12) United States Patent
Brenk

(10) Patent No.: US 7,475,573 B2
(45) Date of Patent: Jan. 13, 2009

(54) PROCESS AND DEVICE FOR TREATMENT OF A TRAVELING YARN WITH A GAS- OR STEAM-CREATING TREATMENT MEDIUM

(75) Inventor: Siegfried Brenk, Krefeld (DE)

(73) Assignee: Saurer GmbH & Co. KG (DE)

( * ) Notice: Subject to any disclaimer, the term of this patent is extended or adjusted under 35 U.S.C. 154(b) by 557 days.

(21) Appl. No.: 10/966,499

(22) Filed: Oct. 15, 2004

(65) Prior Publication Data

US 2005/0102764 A1 May 19, 2005

(30) Foreign Application Priority Data

Oct. 17, 2003 (DE) ..... 103 48 278

(51) Int. Cl.
*D06B 3/04* (2006.01)

(52) U.S. Cl. ..... 68/5 E; 68/5 C

(58) Field of Classification Search ..... 68/5 E, 68/5 C; 8/149.1, 151.2
See application file for complete search history.

(56) References Cited

U.S. PATENT DOCUMENTS 2,708,843 A * 5/1955 Gibson et al. ..... 68/5 E
3,012,427 A * 12/1961 Osban ..... 68/5 E
3,040,553 A * 6/1962 Rust, Jr. ..... 68/175
3,126,724 A * 3/1964 Kolonits ..... 68/5 E
3,343,379 A * 9/1967 Herward et al. ..... 68/5 E
4,565,524 A * 1/1986 Runkel et al. ..... 432/59
6,139,588 A * 10/2000 Foster et al. ..... 8/151.2

* cited by examiner

*Primary Examiner*—Frankie L Stinson
(74) *Attorney, Agent, or Firm*—Robert W. Becker; Robert W. Becker & Assoc.

(57) ABSTRACT

A process for treating a yarn with a gas- or steam-creating medium includes traveling the yarn between a pair of elongate yarn guide elements in a pressure chamber portion of a yarn treatment chamber that is substantially sealed off to the environment and is under an overpressure. The process further includes drawing the yarn through an additional yarn guide element. The cross section of the one pair of elongate yarn guide elements and the cross section of the additional yarn guide element correspond to the thickness (titer) of the yarn traveling through these yarn guide elements such that the yarn travels through these yarn guide elements in a substantially friction-free manner and the one pair of elongate yarn guide elements and the additional yarn guide element operate in cooperation with the yarn treatment chamber such that the yarn treatment chamber is substantially sealed off against loss of pressure.

8 Claims, 11 Drawing Sheets

PROCESS AND DEVICE FOR TREATMENT OF A TRAVELING YARN WITH A GAS- OR STEAM-CREATING TREATMENT MEDIUM

BACKGROUND OF THE INVENTION

The invention relates to a process and a device for treatment of a yarn with a gas- or steam-creating medium.

In order to impart certain properties to a yarn, it is known to treat, in a charge loading manner, a yarn package or, as well, a certain amount of yarn, in an opened or closed chamber either at atmospheric pressure or at an overpressure with a gas- or steam-creating medium that is correspondingly configured to the task of imparting the desired yarn properties.

For a double twisting yarn spindle, it is known from DE 28 11 583 C1 to blow a steam- or gas-creating treatment medium at atmospheric pressure onto a traveling yarn by means of an injection jet.

SUMMARY OF THE INVENTION

The invention provides a solution to the challenge of creating a process and a device by which it is possible to treat a traveling yarn with a gas- or steam-creating medium that is under, i.e. is subjected to, pressure, in that the medium can be applied more thickly onto the individual capillaries over the cross section of the yarn in an overpressure environment, in particular if the yarn tension is low.

In accordance with the invention, inlet-side and outlet-side yarn "sluices" are located respectively upstream and downstream of a yarn treatment chamber through which a yarn travels, the yarn treatment chamber comprising a pressure chamber portion into which a treatment medium, which is subjected to pressure, is blown, whereupon, with respect to the yarn sluices, the traveling yarn itself operates in the function of a sealing element in order to prevent, to the extent possible, an inadvertent exit out of the yarn treatment chamber of the treatment medium subjected to pressure. The individual yarn sluices must, in this connection, be so configured that they permit the travel therepast of yarn thickness locations such as, for example, knot locations or the like, whereby, moreover, the possibility of effecting a threading-in of a yarn, preferably, a pneumatic threading-in of yarn, should be provided.

Preferred embodiments of the invention are treated in the dependent claims.

The invention is described in more detail hereinafter with reference to the drawings.

DESCRIPTION OF SPECIFIC EMBODIMENTS

Figure 1:
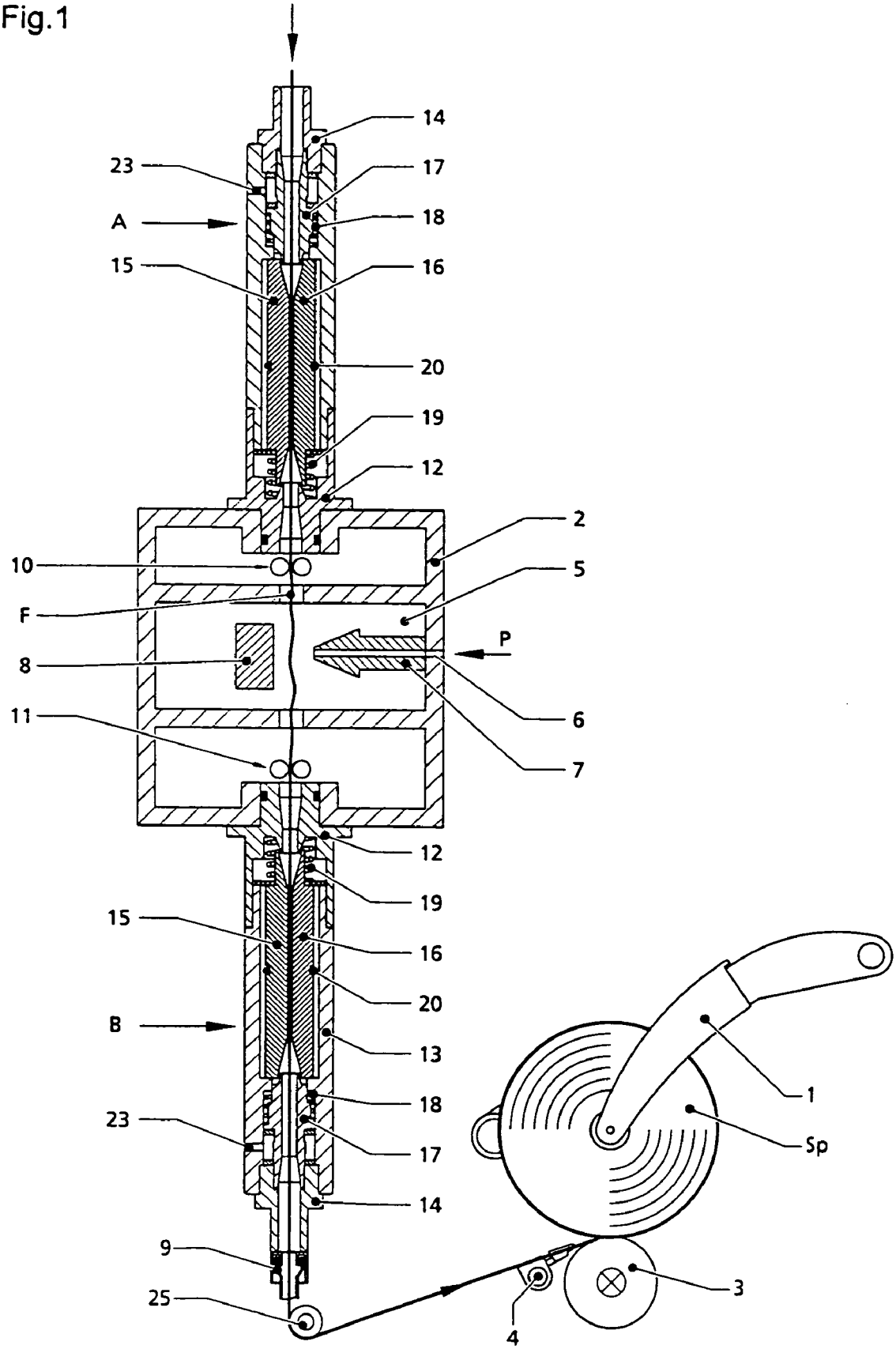
FIG. 1 is an axial section of the inventive device that is upstream of a yarn winding assembly.

FIG. 1 shows, in a schematic illustration, a side view of a yarn winding assembly that is not comprised in the present invention, the yarn winding assembly comprising a package support frame 1 for support of a package tube or, respectively, a package Sp, a frictional drive roller for driving the package Sp, and a yarn direction changing guide 4.

The inventive device comprises, as a portion of a yarn treatment chamber 2, a pressure chamber portion 5 with a connection 6 for the injection via a jet 7 of a treatment medium that is subjected to pressure, the jet having its outlet opening disposed oppositely to an impact surface 8. The yarn treatment chamber 2 is provided with diametrically opposed inlet or, respectively, outlet, openings in which are deployed the yarn sluices A and B that operate to seal off the openings, the yarn sluices being, in substantial parts thereof, identical to each other with the exception that the lower yarn sluice B has a pressurized air injector 9 arranged relative thereto for threading-in a yarn through the yarn sluices A and B and the yarn treatment chamber 2. Two schematically illustrated yarn delivery rollers 10 and 11 are arranged within the yarn treatment chamber 2 in order to convey the yarn F in a substantially tension-free manner through the yarn treatment chamber 2 and the pressure chamber portion 5.

Figure 2:
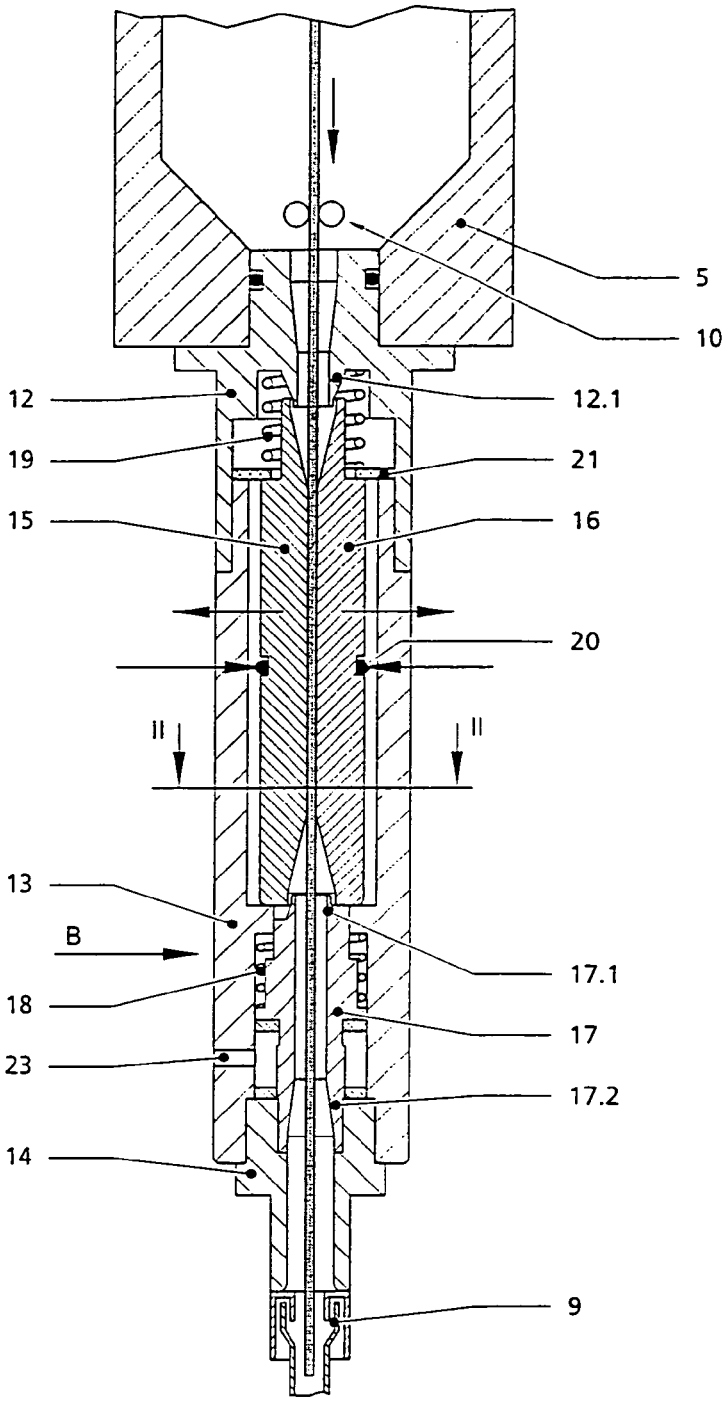
FIG. 2 is an enlarged axial sectional view of a yarn sluice of the inventive device.
Figure 2A:
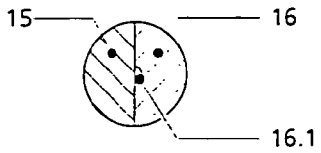
FIG. 2*a* is an axial sectional view of the yarn guide elements according to the line II-II in FIG. 2.
Figure 2B:
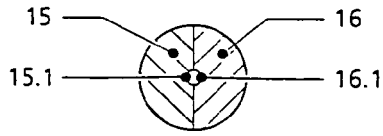
FIG. 2*b* is an axial sectional view of the yarn guide elements according to the line II-II in FIG. 2.

According to FIGS. 1 and 2, each yarn sluice A and B is comprised of the following individual components:

- a connection support 12 deployed in an upper or lower opening of the yarn treatment chamber 2 in a sealing manner with the respective opening;
- a cylinder housing 13 provided on the connection support 12;
- a conduit support 14 mounted in the end of the cylinder housing 13;
- two elongate yarn guide elements 15, 16 mounted within the cylinder housing 13 and having substantially semi-cylindrical cross sections, from which guide elements extend, in accordance with FIGS. 2*a* and 2*b*, at least one longitudinally extending recess 16.1 or, respectively, 15.1, forming a yarn channel;
- a piston 17 displaceably mounted within the cylinder housing 13;
- a restoring spring 18 that is biased against the piston 17;
- a restoring spring 19 that is biased against the yarn guide elements 15, 16;
- a ring spring 20 that presses the pair of yarn guide elements 15, 16 against one another, whereupon the ring spring can also be an O-ring; and
- other conventional sealing elements, for example in the form of ring seals 21.

The connection support 12 is, in connection with the yarn sluice B illustrated in FIG. 2, provided with a downwardly projecting centering- and spreading-cone 12.1. The piston 17 is provided on its top side with an upwardly projecting centering- and spreading-cone 17.1. The pair of yarn guide elements 15 and 16 are configured in their upper and lower ends such that together they bound a substantially conically-shaped inlet or, respectively, outlet opening into which the centering- and spreading-cones 12.1 or, respectively, 17.1, project or, respectively, into which the centering- and spreading-cones can be moved by reason of the spring biased support, on the one hand, of the yarn guide elements 15, 16 and the spring-biased support, on the other hand, of the piston 17.

Figure 3:
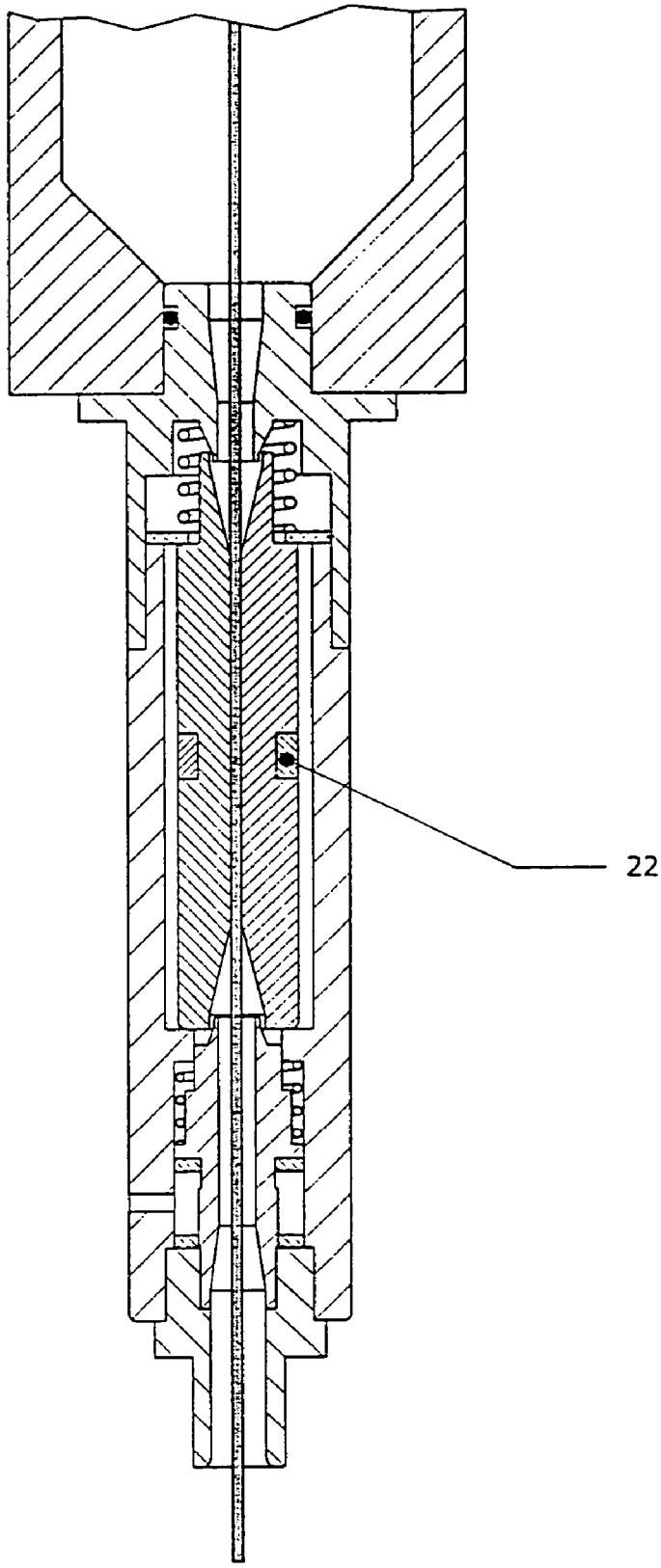
FIG. 3 is an axial sectional view of a different embodiment than that shown in FIG. 2.

The embodiment in accordance with FIG. 3 differentiates itself from the embodiment in accordance with FIG. 2 in that, in lieu of a ring spring 20, opposed magnets 22 are provided in order to press the pair of yarn guide elements against one another.

The yarn sluices must have the following special features:

friction-free and wear-free;

permit the passage therethrough of knots without noticeable increase in the yarn tension;

good capability for threading-in a yarn; and sealing off of the treatment volume relative to the atmosphere in order to keep at the minimum possible the inadvertent loss of treatment medium (steam, special gases, pressurized air).

The yarn channel formed by the two yarn guide elements 15, 16, which are preferably polished, has a yarn pass through cross section that substantially corresponds to the titer or, respectively, the cross section, of the textile yarn that is to be worked. Via this measure, the traveling yarn substantially closes off the yarn channel for the treatment medium that is subjected to pressure, so that only minimal losses of treatment medium occur. The overpressure of the treatment medium that still flows with the yarn through the yarn channel cannot push the pair of yarn guide elements 15, 16 apart, as the effective pressure surface is very low, being substantially limited to the yarn diameter times the length of the yarn pass through channel. This pressure works against the ring spring that maintains the pair of guide elements 15, 16 together. In lieu of a ring spring, an O-ring or magnets 22 (FIG. 3) can also be provided.

The through traveling yarn centers itself between the pair of guide elements as it seeks the way of the lowest frictional opposition. In this manner, no fiber capillaries are clamped between the yarn guide elements 15, 16.

The pair of yarn guide elements are centered by the yarn passing through the pair of lower and upper centering- and spreading-cones 12.1 and 17.1 and, in fact, are centered via the cooperation thereof with the conical inlet or, respectively, outlet openings on the upper and lower ends of the yarn guide elements.

Figure 4:
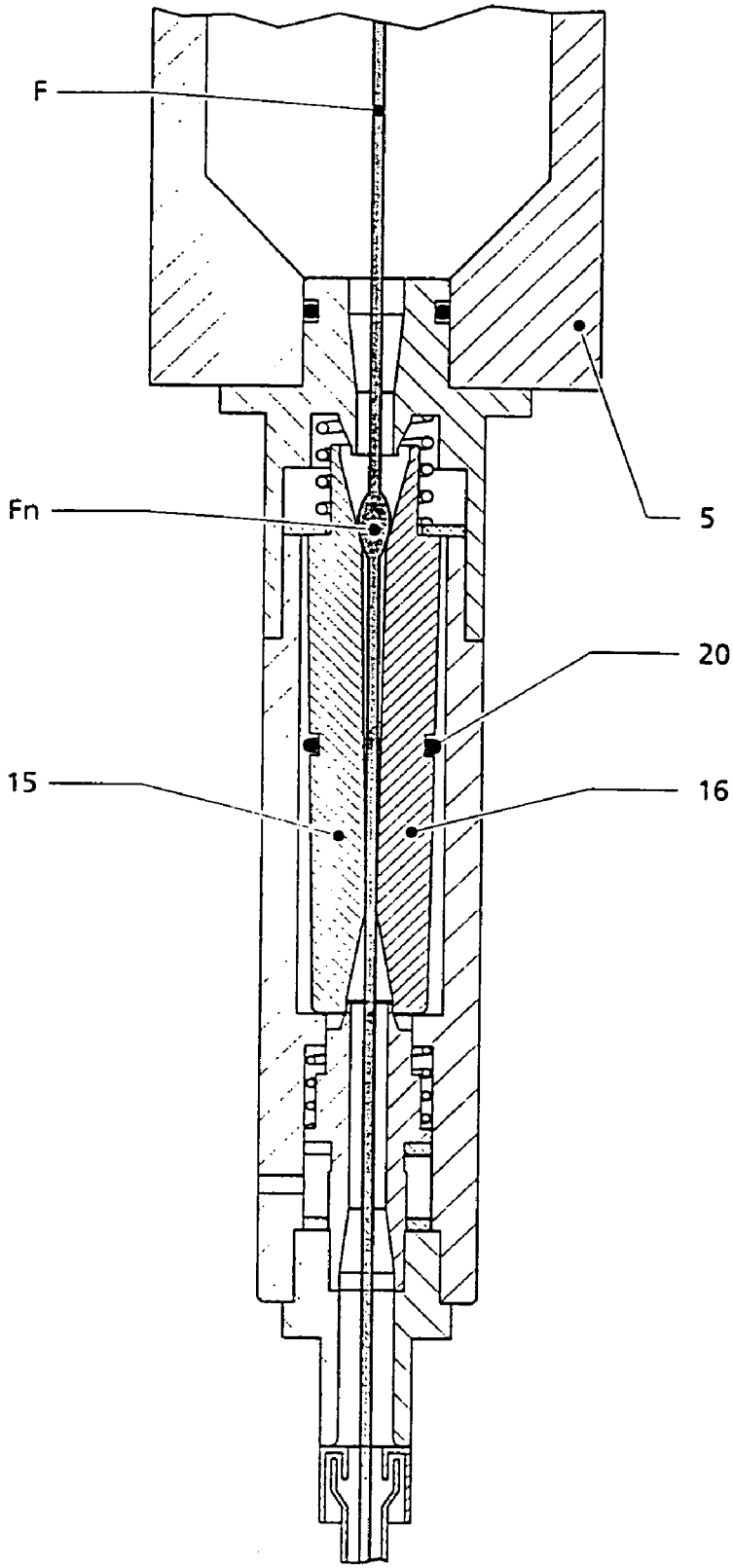
FIG. 4 is an axial sectional view of the inventive device during the through passage of a yarn thickness location.
Figure 5:
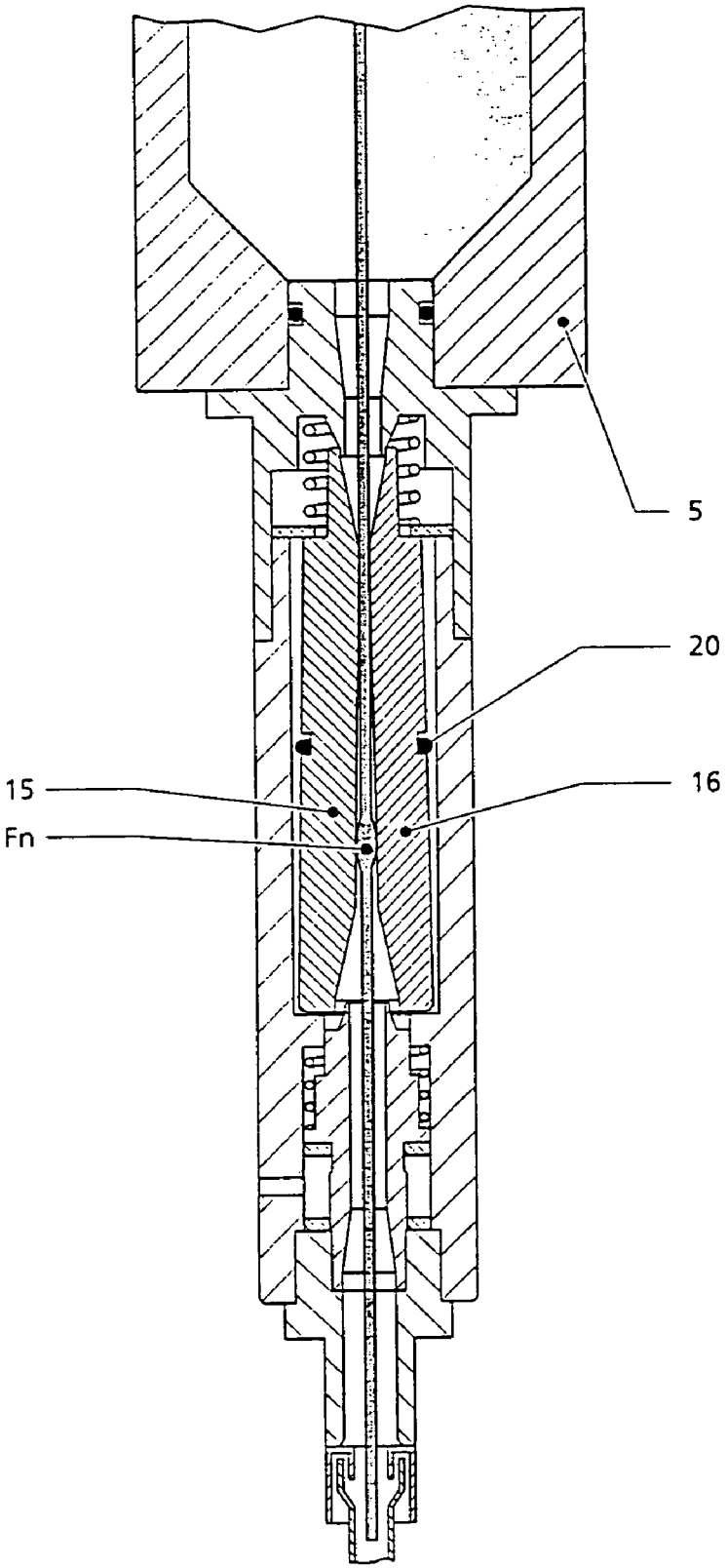
FIG. 5 is an axial sectional view of the inventive device during the through passage of a yarn thickness location.

In accordance with FIGS. 4 and 5, a knot (a yarn thickness location) passing through the yarn sluice B opens the yarn channel between the pair of yarn guide elements that are pressed outwardly against the force of the ring spring 20 (or, respectively, against the force of the magnets 22). The low lateral pressure medium loss that occurs thereby in connection with the through passage of knots can be ignored. After the knots have passed through, the yarn channel is again closed by the "yarn sluices".

The short term pressure of the treatment medium applied on the increasingly larger separation surfaces of the yarn guide elements that occurs during the opening of the yarn channel does not come into play, as this pressure also correspondingly arises on the outward sides of the pair of yarn guide elements.

Figure 6:
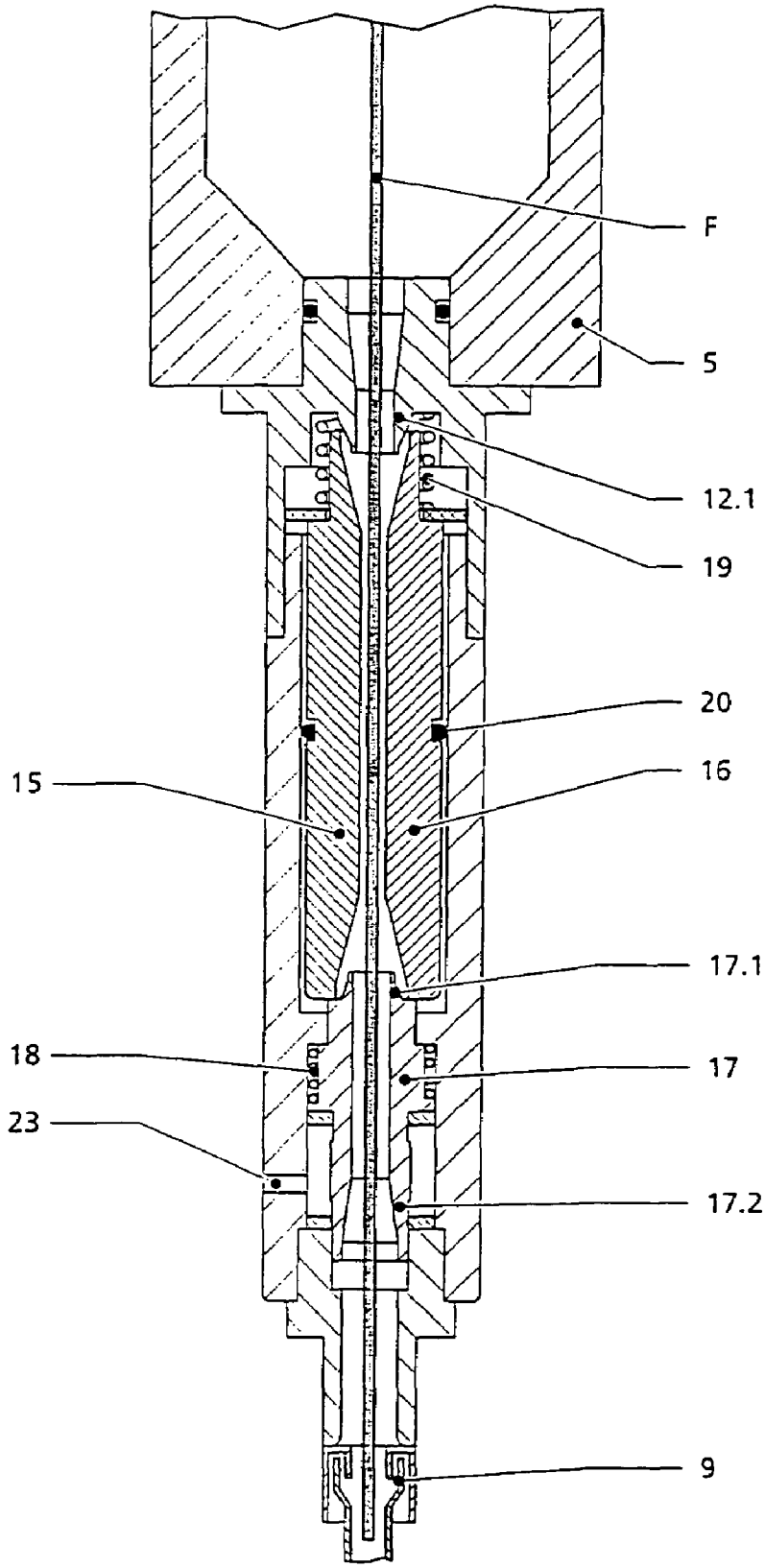
FIG. 6 is an axial sectional view corresponding to that of FIG. 2 during the threading-in of yarn.
Figure 7:
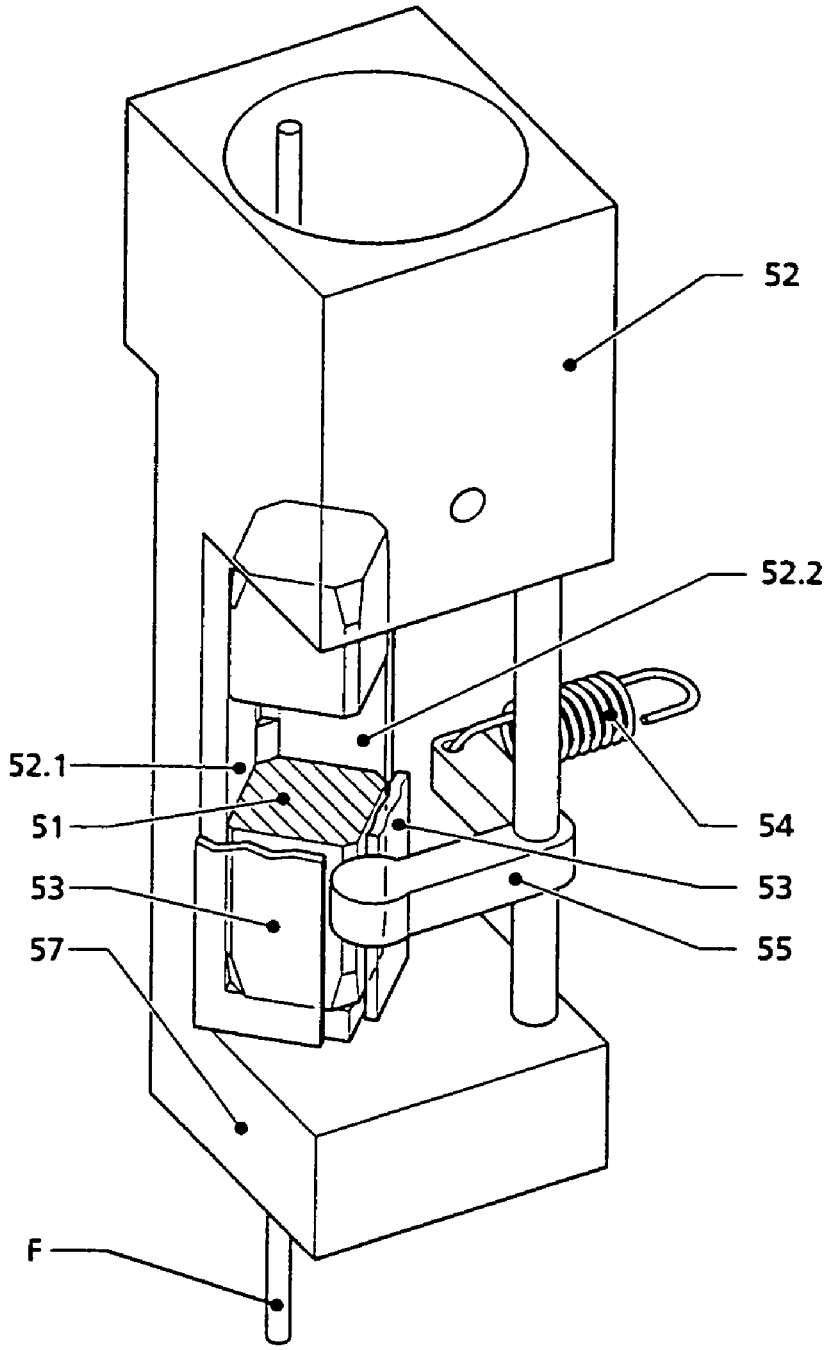
FIG. 7 is a simplified isometric illustration of yet another embodiment of the invention.
Figure 8:
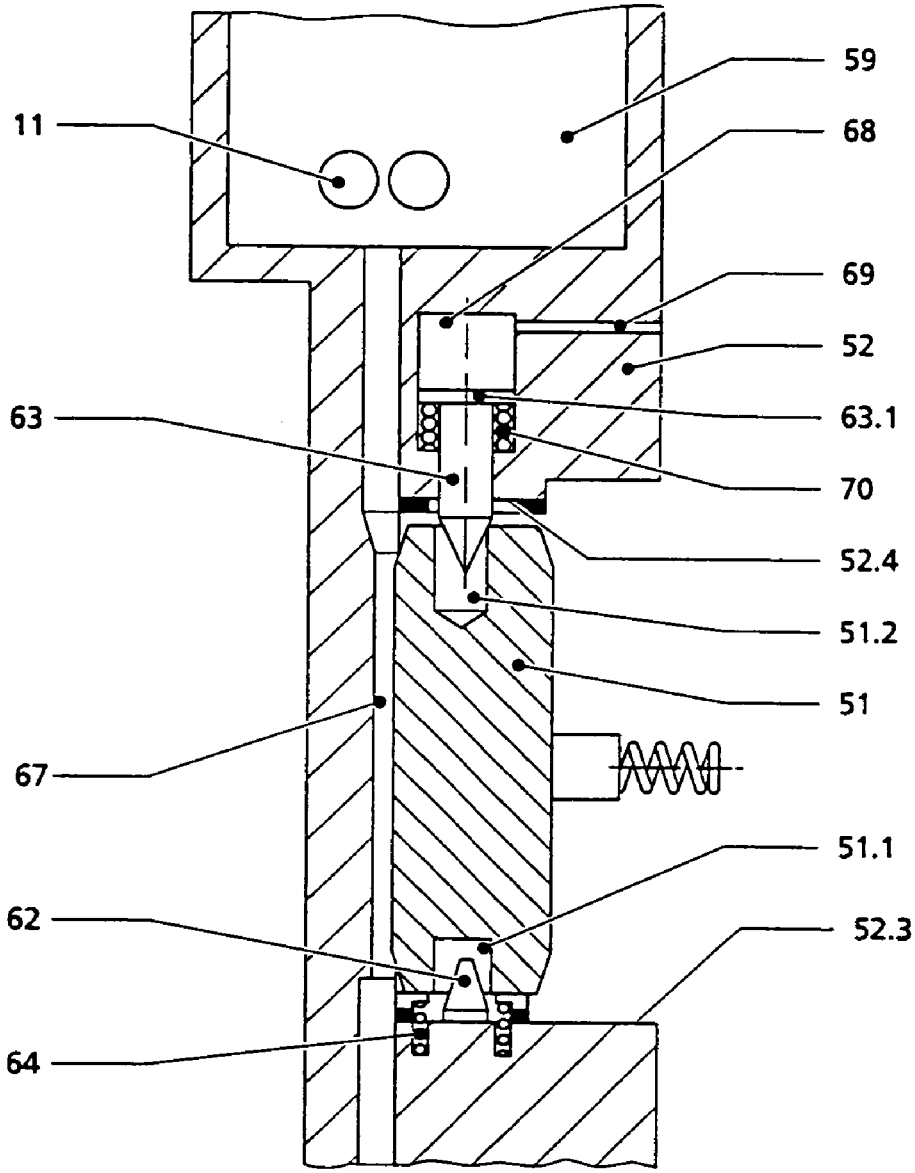
FIG. 8 is a longitudinal sectional view of the device according to FIG. 7 in a selected operational position.

In order to thread in a yarn through the pair of yarn sluices, the yarn guide elements 15, 16 are pushed upwardly by means of the piston 17 against the force of the restoring spring 19, upon impact of the piston 17 with pressurized air supplied via the pressurized air connection 23. As shown in FIG. 6, the pair of centering- and spreading-cones 12.1 and 17.1 are moved into the conical inlet or, respectively, outlet, openings, whereby the pair of yarn guide elements 15, 16 are pressed away from each other along their entire lengths so that a sufficiently large opening cross section for a pneumatic threading-in of yarn is available. The pressurized air injector 9 is impacted in a known manner with pressurized air, in order to produce a suction stream effective in the region of the yarn sluices A and B and the pressure chamber 5.

After the threading-in of the yarn, the piston 17 is released from pressure so that the pair of yarn guide elements 15, 16 as well as the piston 17 are again moved back into their operational positions.

The pair of yarn guide elements 15, 16 of the lower yarn sluice B are supported on their lower ends on a ring shoulder of the housing 13.

In the variation illustrated in FIGS. 7-12, the individual yarn sluices comprise a first yarn guide element 51 in the form of a multiple edge spar—preferably a four-edge spar—on which, in its longitudinal direction, the edges are beveled at respective different spacings from the spar axis. The second yarn guide element is comprised of two support surfaces 52.1; 52.2, disposed at an angle relative to one another, against which the outer surfaces of the four-edge spar 51 can be pressed by means of, for example, a spring 54 operating against a lever 55.

Figure 9:
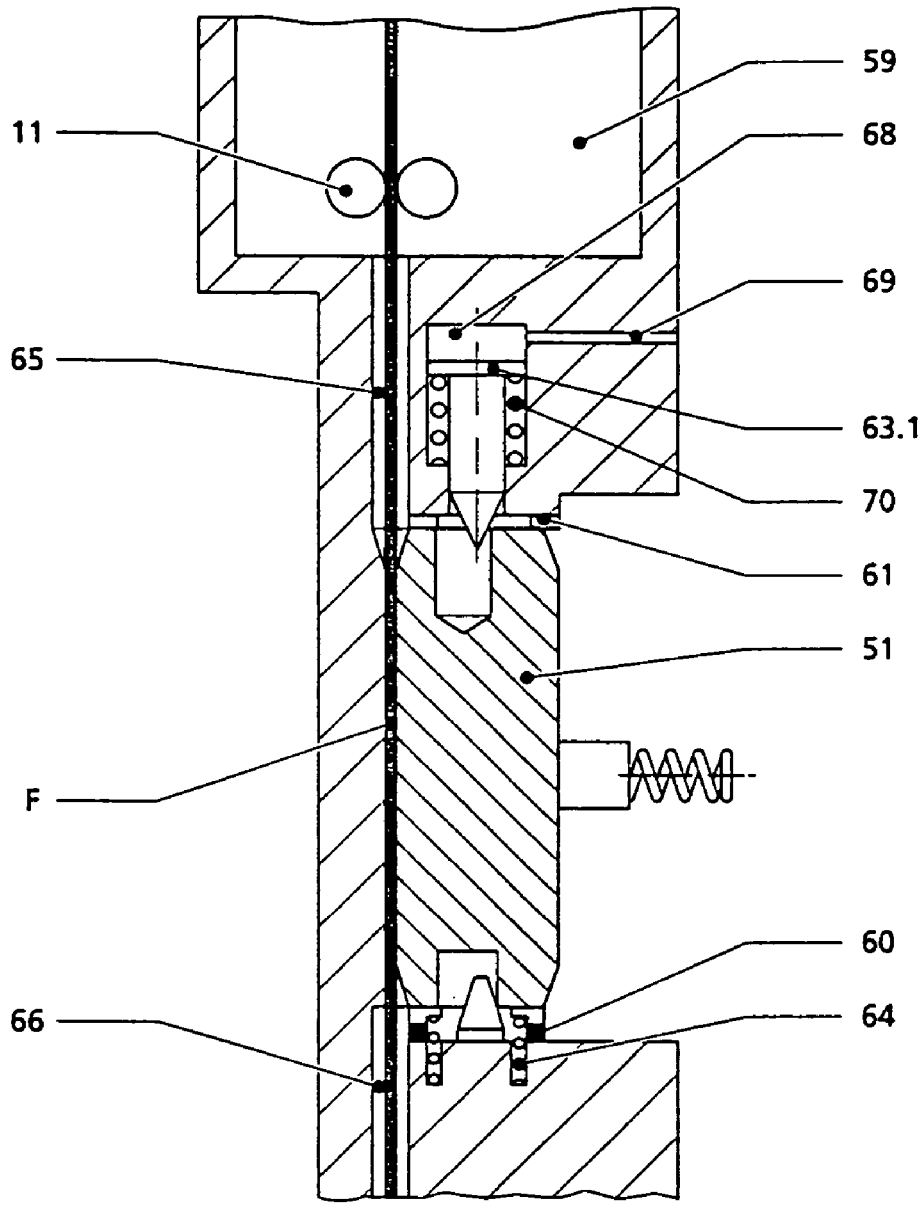
FIG. 9 is a longitudinal sectional view of the device according to FIG. 7 in a selected operational position.
Figure 10:
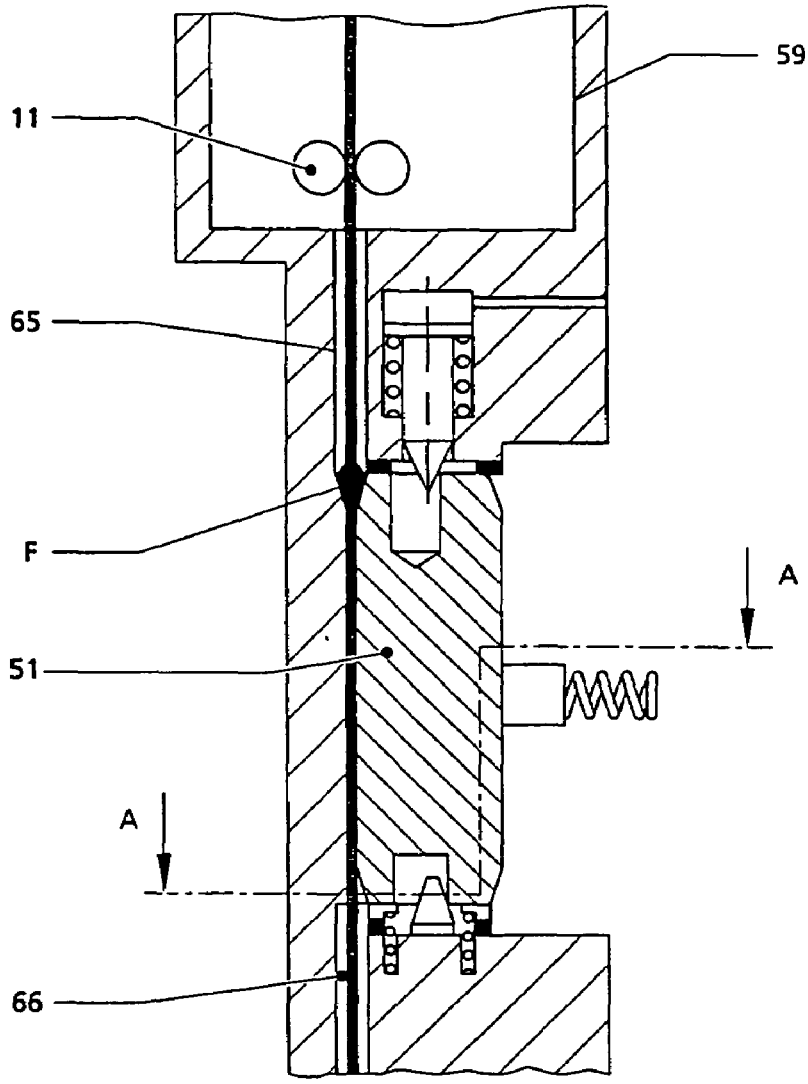
FIG. 10 is a longitudinal sectional view of the device according to FIG. 7 in a selected operational position.

The pair of support surfaces 52.1; 52.2 are comprised as a portion of a retainer block 52 that, additionally, comprises lower and upper seat surfaces 52.3; 52.4, between which the four-edge spar 51 can be supported, by means of sealing rings 60, 61, in the operational position illustrated in FIG. 9. The four-edge spar is provided on its lower end with a blind bore 51.1 extending eccentrically to its middle axis and, on its upper side, with a blind bore 51.2 extending axially parallel to the bore 51.1. Retainer pins 62, 63 oriented coaxial to one another extend in opposition to the bores 51.1 or, respectively, 51.2, the ends of the retainer pins that extend into the bores 51.1, 51.2 being substantially conically shaped. The axes of the pins 62, 63 lie eccentric to the axes of the pair of blind bores 51.1, 51.2. A pressure spring 54 on the underside of the four-edge spar 51 presses the four-edge spar 51 into the operational positions shown in FIGS. 9 and 10 against the upper sealing ring 61.

A yarn channel 65 that is guided via the retaining block 52 is connected to the pressure chamber 59 that forms a portion of the yarn treatment chamber 52 and that has therein the yarn delivery rollers, whereby the yarn channel is disposed in opposition to a yarn channel 66 in the lower region of the retaining block 52, beginning substantially with the lower seat surface 52.3. The pair of yarn channels 65, 66 communicate into the yarn channel 67 formed through the pair of support surfaces 52.1, 52.2 and the oppositely disposed beveled edges of the four-edge spar 51.

Sealing elements 53, that are preferably in the form of sealing tabs, are arranged in the retaining block for sealing the gap between the four-edge spar 51 and the support surfaces 51.1, 51.2.

The spring or an analogous element 54 is so configured that a rotation of the four-edge spar 51 around the pins 62, 63 is possible, whereby it is a necessary condition that the sections of the pair of pins 62, 63 that project into the bores 51.1 or, respectively, 51.2, of the four-edge spar 51 have a defined, smaller diameter than that of the bores of 51.1, 51.2 themselves, so that the four-edge spar 51 can, upon rotation around the pins 62, 63, deviate laterally.

The upper pin 63 supports a piston 63.1 that is guided in a sealed-off manner in a cylinder chamber 68 into which is communicated a pressure medium connection 69. Upon impact of the cylinder chamber 68 with a pressure medium, the piston 63.1 and, consequently, the pin 63, are pressed downwardly against the force of a restoring spring 70, whereby at the same time, the four-edge spar 51 is downwardly displaced against the force of the lower restoring spring 64. Since the axes of the pins 62, 63 are laterally offset relative to the axes of the bores 51.1, 51.2 and, in fact, are spaced away from the corners formed via the support surfaces 52.1; 52.1, the four-edge spar 51 is moved away out of these corners by means of the conically shaped ends of the pins 62, 63, whereby the yarn channel 67 is enlarged for the purpose of threading-in a yarn.

Figure 12:
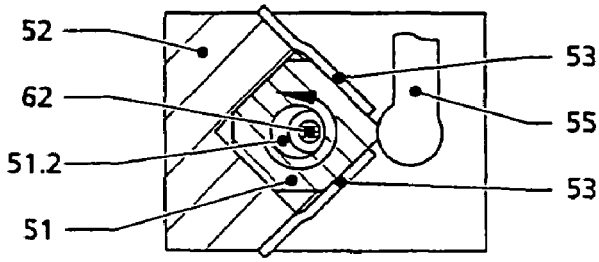
FIG. 12 shows a horizontal sectional view along the cut line A-A in FIG. 10.
Figure 11:
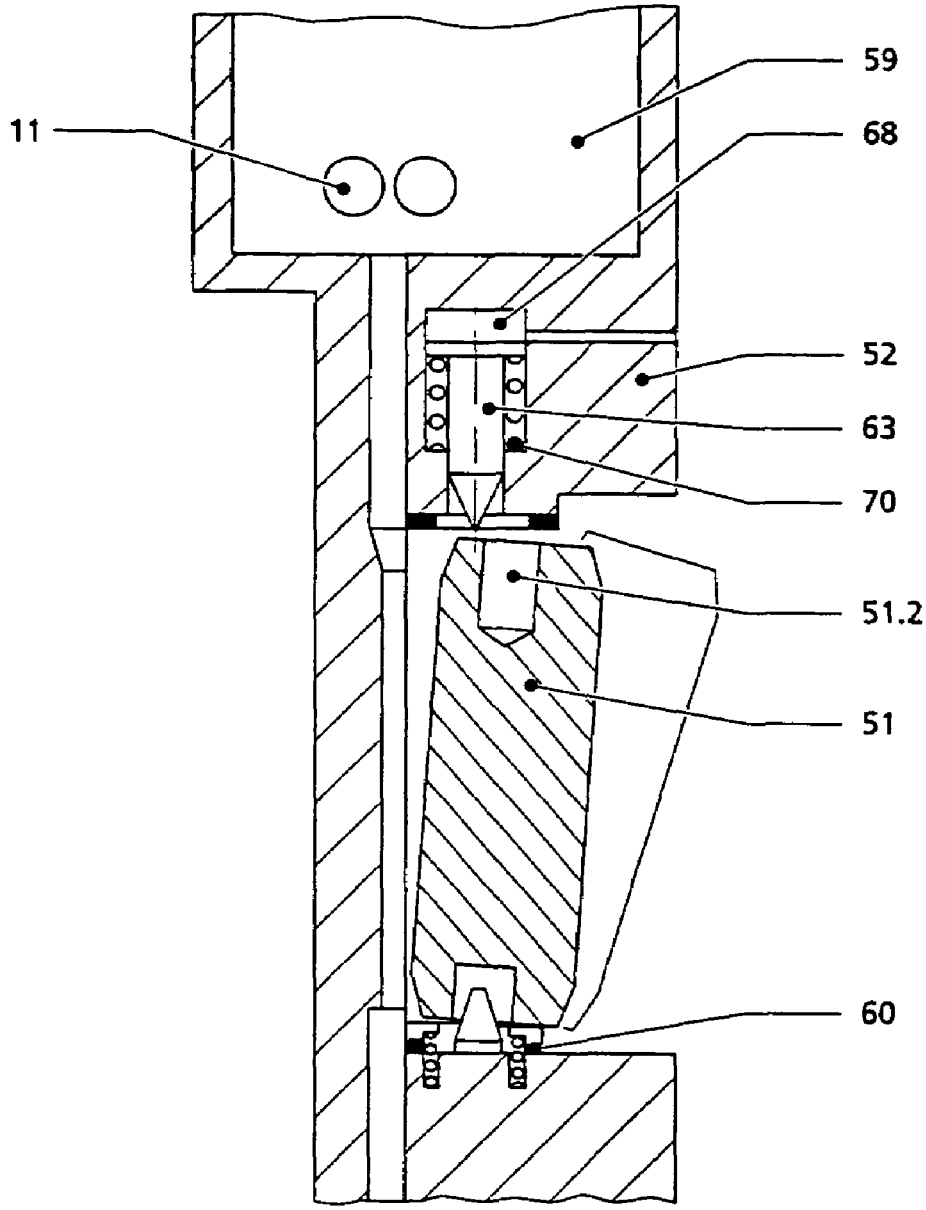
FIG. 11 is a longitudinal sectional view of the device according to FIG. 7 in a selected operational position.

The four-edge spar 51 can, in accordance with FIG. 11, be manually swung to the side of the retaining block 52 by means of the pins 63 moved into the cylinder chamber 68, whereby the lower seal ring 60 must have an adequate elasticity for this operation. In this manner, the possibility exists to exchange out the four-edge spars for other four-edge spars with differently beveled edges. This exchange is not to be confused with the rotation, for example as shown in FIG. 12, of a four-edge spar 51, which is undertaken for the purpose of bringing different beveled longitudinal edges of one and the same four-edge spar 51 into opposed dispositions with the corner formed by the pair of support surfaces 52.1, 52.2.

FIG. 9 shows the yarn F as it exits the yarn treatment chamber 59, the yarn, as is the case with respect to the device in accordance with FIGS. 1-6, sealing off the yarn channel 67 between the pair of support surfaces 52.1, 52.2 and the four-edge spar 51. A corresponding system is mounted, on the inlet side end of the treatment or, respectively, the pressure, chamber 59, such as is described with respect to FIGS. 7-12.

In order to avoid, during running-in of a yarn thickness location Fn in the yarn channel 67, the occurrence of damage to the yarn and to facilitate threading-in of a yarn into the yarn channel 67, the beveled surfaces of the four-edge spar 51 are contacted inwardly at least on a rear side of the four-edge spar 51.

The specification incorporates by reference the disclosure of German priority document 103 48 278.4 filed Oct. 17, 2003.

The present invention is, of course, in no way restricted to the specific disclosure of the specification and drawings, but also encompasses any modifications within the scope of the appended claims.

The invention claimed is:

1. A device for treatment of a traveling yarn with a gas- or steam-creating medium, comprising:

a yarn treatment chamber through which a yarn travels, the yarn treatment chamber being substantially sealed off to the environment and provided with a yarn inlet opening and a yarn outlet opening, each of these openings having a yarn sluice arranged relative thereto that, on the one hand, permits a through passage of the yarn including those portions of the yarn having thickness locations and, on the other hand, permits the respective opening to be substantially closed relative to the atmosphere via the passage of the yarn traveling through the respective yarn sluice; and a pressure chamber enclosed within the yarn treatment chamber having a connection for introducing a pressurized medium into the pressure chamber portion, wherein each yarn sluice includes a respective one of a pair of elongate yarn guide elements each of which bounds, in its longitudinal direction, a yarn pass through channel, from which at least one yarn guide element is adjustable against a restoring force relative to the other yarn guide element in a direction substantially perpendicular to the yarn travel direction, wherein the respective pairs of yarn guide elements each have a semi-cylindrical cross section, and comprise, in the region of the oppositely disposed separation surfaces of the pair of yarn guide elements a recess extending in the longitudinal direction, whose cross section is set as a function of the thickness (titer) of the yarn to be treated, wherein the respective pairs of yarn guide elements are mounted within a cylinder housing for displaceable movement against a spring force, and further comprising, in the region of the yarn inlet- and the yarn outlet-sides of the yarn guide elements centering- and spreading-cone elements by means of which the pair of yarn guide elements, when they are displaced in the longitudinal direction against the spring force, are moved away from one another, wherein each centering- and spreading-cone element includes, in the region of the separation surfaces of the pair of yarn guide elements a conical bore that extends concentrically to the yarn pass through direction and that tapers in the direction from its outside towards its inside and, on the other side, comprises a truncated centering- and spreading-cone tapering in the direction of the pair of yarn guide elements from which one of the truncated centering- and spreading-cones is displaceable relative to the other truncated centering- and spreading-cone.

2. A device according to claim 1 wherein each displaceable truncated centering- and spreading-cone is a portion of a piston guidably supported in a cylinder bore, the piston, in the region of the truncated centering- and spreading-cone, having a ring shoulder to temporarily support one of the yarn guide elements and the piston being displaceable against the force of a restoring spring in the direction of the yarn guide element associated therewith.

3. A device according to claim 2, wherein the respective pairs of yarn guide elements are displaceable against the force of a restoring spring in the direction of the pressure chamber.

4. A device according to claim 1, wherein the respective pairs of yarn guide elements are pressed against one another by means of at least one O-ring.

5. A device according to claim 1, wherein the respective pairs of yarn guide elements are pressed against each other by means of at least one spring, in particular, a ring spring.

6. A device according to claim 1, wherein the respective pairs of yarn guide elements are pressed against each other in a magnetic manner.

7. A device according to claim 1, wherein, within the yarn treatment device, yarn delivery rollers are mounted in order to convey the yarn through the yarn treatment device In a substantially tension-free manner.

8. A device according to claim 1, and further comprising a suction source, preferably in the form of a pressurized air activated injector, arranged relative to the yarn sluice disposed on the outlet side of the yarn treatment device.

* * * * *